US009518469B2

(12) United States Patent
Tibbott et al.

(10) Patent No.: US 9,518,469 B2
(45) Date of Patent: Dec. 13, 2016

(54) GAS TURBINE ENGINE COMPONENT

(71) Applicant: ROLLS-ROYCE PLC, London (GB)

(72) Inventors: Ian Tibbott, Lichfield (GB); Dougal Richard Jackson, Stanton by Bridge (GB)

(73) Assignee: ROLLS-ROYCE plc, London (GB)

( * ) Notice: Subject to any disclaimer, the term of this patent is extended or adjusted under 35 U.S.C. 154(b) by 595 days.

(21) Appl. No.: 14/033,900

(22) Filed: Sep. 23, 2013

(65) Prior Publication Data

US 2014/0086724 A1 Mar. 27, 2014

(30) Foreign Application Priority Data

Sep. 26, 2012 (GB) ..... 1217125.2

(51) Int. Cl.
*F01D 5/18* (2006.01)

(52) U.S. Cl.
CPC ..... *F01D 5/186* (2013.01); *F01D 5/187* (2013.01); *F05D 2260/22141* (2013.01); *Y10T 29/49336* (2015.01)

(58) Field of Classification Search
CPC ..... F05D 2240/127; Y10T 29/49336
See application file for complete search history.

(56) References Cited

U.S. PATENT DOCUMENTS 4,278,400 A * 7/1981 Yamarik ..... F01D 5/187 415/115
4,474,532 A * 10/1984 Pazder ..... F01D 5/187 415/115

(Continued)

FOREIGN PATENT DOCUMENTS

EP 1 467 065 A2 10/2004
EP 1 715 139 A2 10/2006

(Continued)

OTHER PUBLICATIONS

Jan. 21, 2014 Search Report issued in European Patent Application No. EP 13 18 5647.

(Continued)

*Primary Examiner* — Eric Keasel
*Assistant Examiner* — Jason Davis
(74) *Attorney, Agent, or Firm* — Oliff PLC

(57) ABSTRACT

An internally cooled gas turbine engine component has a line of cooling air discharge holes, an internal cooling channel, an internal feed cavity for feeding cooling air from the channel to the discharge holes, and flow disrupting pedestals arranged in rows. A method of configuring the component includes:

determining angles $\alpha$ and $\beta$ of the directions of cooling air flow into the first and $N^{th}$ rows, respectively;

defining a change in angle $\phi$ of the direction of cooling air flow between rows as $\phi=(\beta-\alpha)/N$; and positioning the pedestals such that a line extending forward from the center of each pedestal in the $i^{th}$ row at an angle $\{\alpha+\phi(i-1)\}$ intersects the $(i-1)^{th}$ row at a location which is midway between two neighboring pedestals of the $(i-1)^{th}$ row, i being an integer from 2 to N.

15 Claims, 11 Drawing Sheets

(56) References Cited

U.S. PATENT DOCUMENTS

| | | | | |
|---|---|---|---|---|
| 4,786,233 | A * | 11/1988 | Shizuya | F01D 5/187 416/90 R |
| 5,462,405 | A | 10/1995 | Hoff et al. | |
| 5,772,397 | A | 6/1998 | Morris et al. | |
| 6,929,451 | B2 * | 8/2005 | Gregg | F01D 5/16 416/500 |
| 8,070,441 | B1 | 12/2011 | Liang | |
| 8,585,351 | B2 * | 11/2013 | Bregman | F01D 5/187 415/115 |
| 2013/0052036 | A1 * | 2/2013 | Smith | F01D 5/188 416/97 R |

FOREIGN PATENT DOCUMENTS

| | | | | |
|---|---|---|---|---|
| EP | 1 775 420 | A2 | 4/2007 | |
| EP | 2 378 073 | A1 | 10/2011 | |
| EP | 2 489 838 | A2 | 8/2012 | |
| GB | 2 210 415 | A | 6/1989 | |
| WO | WO 2011160930 | A1 * | 12/2011 | F01D 5/187 |

OTHER PUBLICATIONS

European Search Report issued in Application No. 1217125.2; Dated Jan. 22, 2013.

* cited by examiner

GAS TURBINE ENGINE COMPONENT

The present invention relates to a method of configuring an internally cooled gas turbine engine component.

The performance of the simple gas turbine engine cycle, whether measured in terms of efficiency or specific output, is improved by increasing the turbine gas temperature. It is therefore desirable to operate the turbine at the highest possible temperature. For any engine cycle compression ratio or bypass ratio, increasing the turbine entry gas temperature always produces more specific thrust (e.g. engine thrust per unit of air mass flow). However, as turbine entry temperatures increase, the life of an uncooled turbine falls, necessitating the development of better materials and the introduction of internal air cooling.

In modern engines, the high pressure (HP) turbine gas temperatures are now much hotter than the melting point of the blade materials used, and in some engine designs the intermediate pressure (IP) and low pressure (LP) turbines are also cooled. During its passage through the turbine, the mean temperature of the gas stream decreases as power is extracted. Therefore the need to cool the static and rotary parts of the engine structure decreases as the gas moves from the HP stage(s) through the IP and LP stages towards the exit nozzle.

Internal convection and external films are the main methods of cooling the aerofoils. HP turbine nozzle guide vanes (NGV's) consume the greatest amount of cooling air on high temperature engines. HP blades typically use about half of the NGV cooling air flow. The IP and LP stages downstream of the HP turbine use progressively less cooling air.

FIG. 1 shows an isometric view of a conventional HP stage cooled turbine. Block arrows indicate cooling air flows. The stage has NGVs 100 and HP rotor blades 102 downstream of the NGVs. The NGVs 100 and HP blades 102 are cooled by using high pressure air from the compressor that has by-passed the combustor and is therefore relatively cool compared to the working gas temperature. Typical cooling air temperatures are between 800 and 1000 K. Mainstream gas temperatures can be in excess of 2100 K.

The cooling air from the compressor that is used to cool the hot turbine components is not used fully to extract work from the turbine. Extracting coolant flow therefore has an adverse effect on the engine operating efficiency. It is thus important to use this cooling air as effectively as possible.

In order to maintain acceptable component lives in particularly the HP rotor blades, more effective cooling schemes have been adopted, such as impingement leading edge cooling arrangements and trailing edge schemes that have separate dedicated feed systems. Typically the body of the aerofoil is cooled with a forward or rearward flowing multipass or serpentine series of linked cooling passages.

The ever increasing gas temperature level combined with higher engine overall pressure ratios, have resulted in an increase in local coating and metal temperatures particularly in trailing edge passages which are cooled using a combination of internal convection and external film cooling. Ensuring good flow distribution and heat transfer augmentation has been a long term problem for thermo-fluids engineers.

FIG. 2 shows a rearward flowing multipass cooling arrangement in an HP rotor blade 102, block arrows indicating cooling air flow. An internal cooling channel 104 makes three passes along the length of the blade. Discharge slots 106 for film cooling the extreme suction surface of the aerofoil are provided along the trailing edge 108 of the blade and are fed from the third pass. FIG. 3 shows a multipass cooling arrangement in another HP rotor blade 102. In this case, the trailing edge discharge slots 106 are fed from a dedicated cooling channel 110.

In the both cases, the cooling channel 104, 110 is fed from the bucket grove, formed between the rotor disc inboard serration and the base of the rotor blade fir tree attachment 112, and contains heat transfer augmentation features such as trip strips 114. A feed cavity 116 between the channel and the line of discharge slots 106 feeds cooling air from the channel to the slots. The pressure in the cooling channel 104, 110 is at an elevated level in order to stream coolant through film cooling holes onto the late pressure surface of the aerofoil. However, due to casting slot width constraints, the pressure is too high to freely film cool the extreme suction surface through the slots 106. Consequently, rows of pedestals 118 in the feed cavity are employed to produce a pressure drop and to convectively cool the rear portion of the aerofoil upstream of the slots.

The incident angle of attack experienced by the first row of pedestals 118, changes from the blade root to tip as the coolant flows in a radial direction up the channel 104, 110. For example at the inboard end of the channel the flow is almost radial in direction, and at the outboard end of the channel the flow direction is almost axial. However, the transition from radial to axial is generally not linear from root to tip and therefore cannot be easily accommodated by repositioning the pedestal rows. In addition, the direction of the flow changes from row to row in the axial direction to eventually align itself with the trailing edge slots 106, through which the coolant flows wholly axially at the root and largely axially at the tip.

There are different options for arranging the pedestals 118. FIGS. 4 (*a*) and 4 (*b*) show close-up views of the trailing edge region of two blades of the type shown in FIG. 3. In (a) the pedestals are arranged in staggered rows (forming a hexagonal lattice), and in (b) the pedestals are arranged in aligned rows (forming a square lattice).

FIGS. 5 (*a*) and 5 (*b*) show 3D computational fluid dynamics (CFD) streak lines for 5 (*a*) staggered and 5 (*b*) aligned pedestal formations. Neither formation appears to deliver the desired flow structure normally associated with pedestal banks. More particularly, in both formations there is evidence of undesirable coolant "jetting" between the pedestal rows. The "jetting" angle appears to be shallower (about 10°) in case (b) of in-line pedestals, and steeper (about 30°) in case (a) of staggered pedestals.

In FIGS. 2 to 5 (*a*) and 5 (*b*), the pedestals 118 are in the form of columns of circular cross-section. Another option, however, is for the pedestals to be in the form of columns of racetrack-shaped or elliptical cross-section. Such pedestals can increase the pressure drop between the channel 104, 110 and the discharge slots 106. FIG. 6 shows 3D CFD streak lines for staggered racetrack-shaped pedestals. Coolant "jetting" still occurs with the angle of the "jetting" flow even steeper than the previous cases with circular pedestals. Further there is little or no coolant flow in the wakes of the racetrack-shaped pedestals. This poor flow structure reduces the obtainable pressure drop and is also undesirable from turbulent mixing and local heat transfer perspectives. In particular, the absence of coolant outside the "jets" can cause localised hot spots and high thermal gradients, which in turn can lead to premature oxidation and reductions in thermal fatigue life. Undesirable flow separation around the flow straightening lands of the discharge slots can also lead to local over-heating. Further, poor flow distribution in the discharge slots can seriously affect the trailing edge film effectiveness, which can lead to thermal cracking and over-heating in what is typically the highest temperature location of the aerofoil. These problems tend to be exacerbated when non-circular pedestals are used.

The present invention is at least partly based on a recognition that a more desirable flow structure in the feed cavity 116 would be one in which the flow splits evenly at the pedestal stagnation point at the front of each pedestal and then remains attached to the curved surface of the pedestals for as long as possible before shedding to form a wake immediately downstream of each pedestal. Such a structure would cause the flow to meander in and out of the pedestals as the flow passes from row to row towards the discharge slots 106.

Accordingly, in a first aspect, the present invention provides a method of configuring an internally cooled gas turbine engine component, the component having a line of cooling air discharge holes, an internal cooling channel forward of and extending substantially parallel to the line of discharge holes, and an internal feed cavity between the channel and the line of discharge holes for feeding cooling air from the channel to the discharge holes, the component further having a plurality of flow disrupting pedestals extending between opposing sides of the feed cavity, the pedestals being arranged in a number N of rows which extend substantially parallel to the line of discharge holes, the first row being at the entrance from the channel to the feed cavity, the $N^{th}$ row being at the exit from the feed cavity to the discharge holes, the remaining rows being spaced therebetween, and the pedestals being spaced apart from each other within each row, the method including:

determining an angle $\alpha$ of the direction of cooling air flow into the first row;

determining an angle $\beta$ of the direction of cooling air flow from the $N^{th}$ row;

defining a change in angle $\phi$ of the direction of cooling air flow between rows as $\phi=(\beta-\alpha)/N$; and positioning the pedestals such that a line extending forward from the centre of each pedestal in the $i^{th}$ row at an angle $\{\alpha+\phi(i-1)\}$ intersects the $(i-1)^{th}$ row at a location which is midway between two neighbouring pedestals of the $(i-1)^{th}$ row, i being an integer from 2 to N.

By applying this methodology, it is possible to configure the pedestal rows such that the flow structure in the feed cavity has the more desirable flow structure described above In a second aspect, the present invention provides a process for producing an internally cooled gas turbine engine component, the process including:

configuring the component by performing the method of the first aspect; and manufacturing the configured component.

In a third aspect, the present invention provides an internally cooled gas turbine engine component produced by the process of the second aspect.

In a fourth aspect, the present invention provides an internally cooled gas turbine engine component, the component having:

a line of cooling air discharge holes, an internal cooling channel forward of and extending substantially parallel to the line of discharge holes, an internal feed cavity between the channel and the line of discharge holes for feeding cooling air from the channel to the discharge holes, and a plurality of flow disrupting pedestals extending between opposing sides of the feed cavity, the pedestals being arranged in a number N of rows which extend substantially parallel to the line of discharge holes, the first row being at the entrance from the channel to the feed cavity, the $N^{th}$ row being at the exit from the feed cavity to the discharge holes, the remaining rows being spaced therebetween, and the pedestals being spaced apart from each other within each row;

wherein each pedestal is positioned such that the streak lines of the cooling air advancing on the pedestal split substantially equally to both sides of the pedestal and then substantially completely recombine downstream of the pedestal Optional features of the invention will now be set out. These are applicable singly or in any combination with any aspect of the invention.

The pedestals can bridge the opposing sides of the feed cavity, or can project from one side leaving a gap between the end of the pedestal and the opposing side, or can project from one side leaving a gap between the end of the pedestal and the end of another pedestal projecting from the other side (when the pedestals leave such gaps they may be referred to as pin fins).

Typically N is four or more. The rows may be spaced substantially equal distances apart.

The determination of the angle $\alpha$ can be performed by computer modelling of the cooling air flow through the component, the pedestals occupying provisional positions in the feed cavity for the modelling. For example, the provisional positions can be staggered rows of pedestals.

The determination of the angle $\beta$ can be such that the direction of cooling air flow from the $N^{th}$ row is the same as the direction of cooling air flow through the discharge holes.

Preferably, the method may further include:

determining the number of pedestals in the $N^{th}$ row such that each pedestal of the $N^{th}$ row corresponds to a respective one of the discharge holes; and positioning each pedestal of the $N^{th}$ row such that a line extending rearward therefrom at angle $\beta$ coincides with the centre of the respective discharge hole.

The pedestals can be columns of circular cross-section. However, another option is for the pedestals to be columns of racetrack-shaped or elliptical cross-section. In this case, the method may further include: orientating the pedestals such that the long axis of the racetrack-shaped or elliptical cross-section of each pedestal is perpendicular to a line extending forward from the centre of each pedestal in the $i^{th}$ row at an angle $\{\alpha+\phi(i-1)\}$, i being an integer from 1 to N. In this way, the pressure drop across the cavity can be increased.

Other possible shapes for the pedestals include teardrop-shaped, banana-shaped, diamond-shaped, and aerofoil-shaped cross-section columns. The pedestals can taper from one side to the other of the feed cavity. Differently shaped pedestals can be used in combination. The pedestals may also be used in combination with trip strips, turning vanes etc.

In general, the value of the angle $\alpha$ may vary along the length of the first row.

The component may be a gas turbine aerofoil, such as a turbine blade or a guide vane, the pedestals extending between pressure surface and suction surface sides of the feed cavity. However, the methodology may be applied to other components, such as a shroud segment, a shroud segment liner, or a wall panel of a combustor.

When the component is a gas turbine aerofoil the line of cooling air discharge holes may be a line of slots along the trailing edge of the aerofoil.

Further optional features of the invention are set out below.

Embodiments of the invention will now be described by way of example with reference to the accompanying drawings in which.

Figure 1:
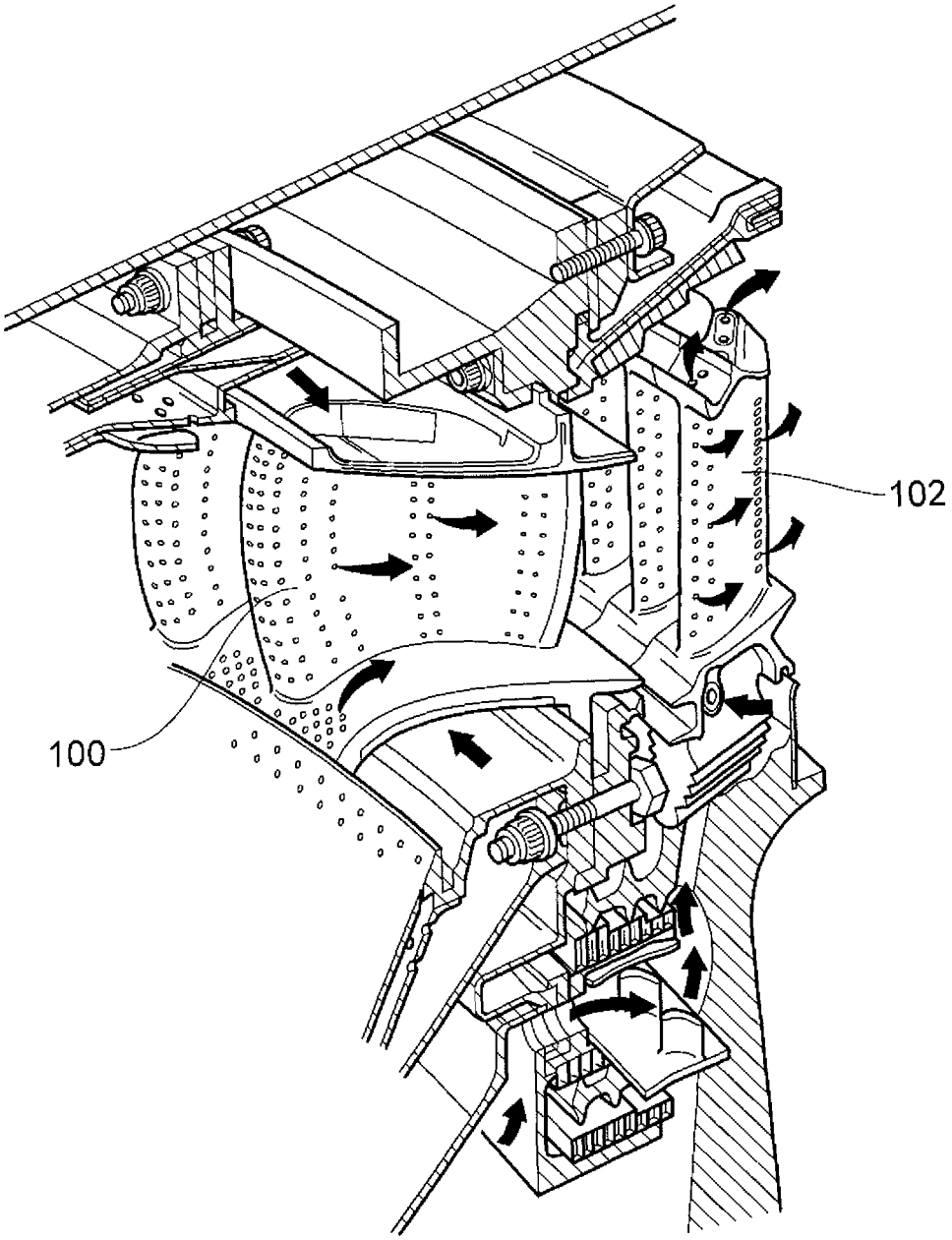
FIG. 1 (PRIOR ART)
FIG. 1 shows an isometric view of a conventional HP stage cooled turbine.
Figure 2:
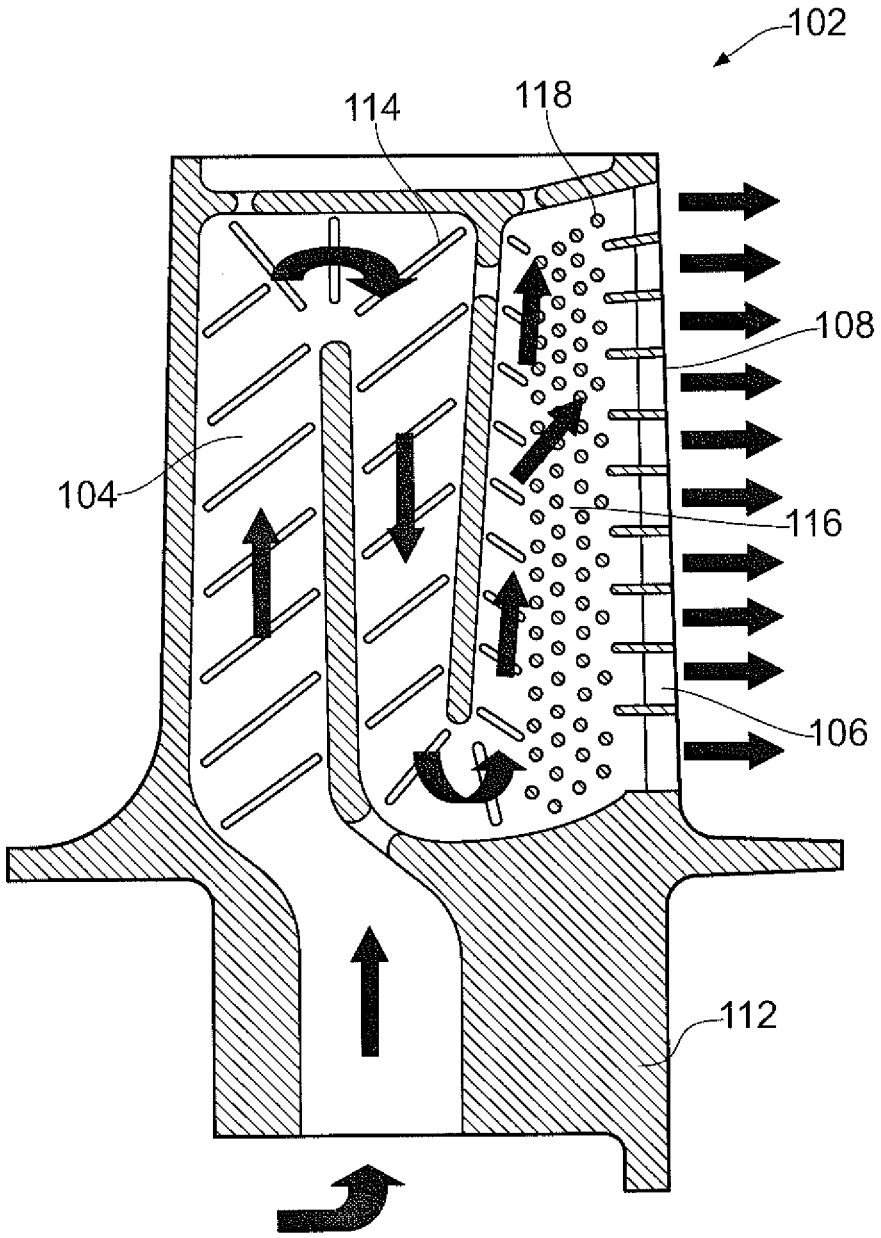
FIG. 2 shows a cross-section though an HP rotor blade.
Figure 3:
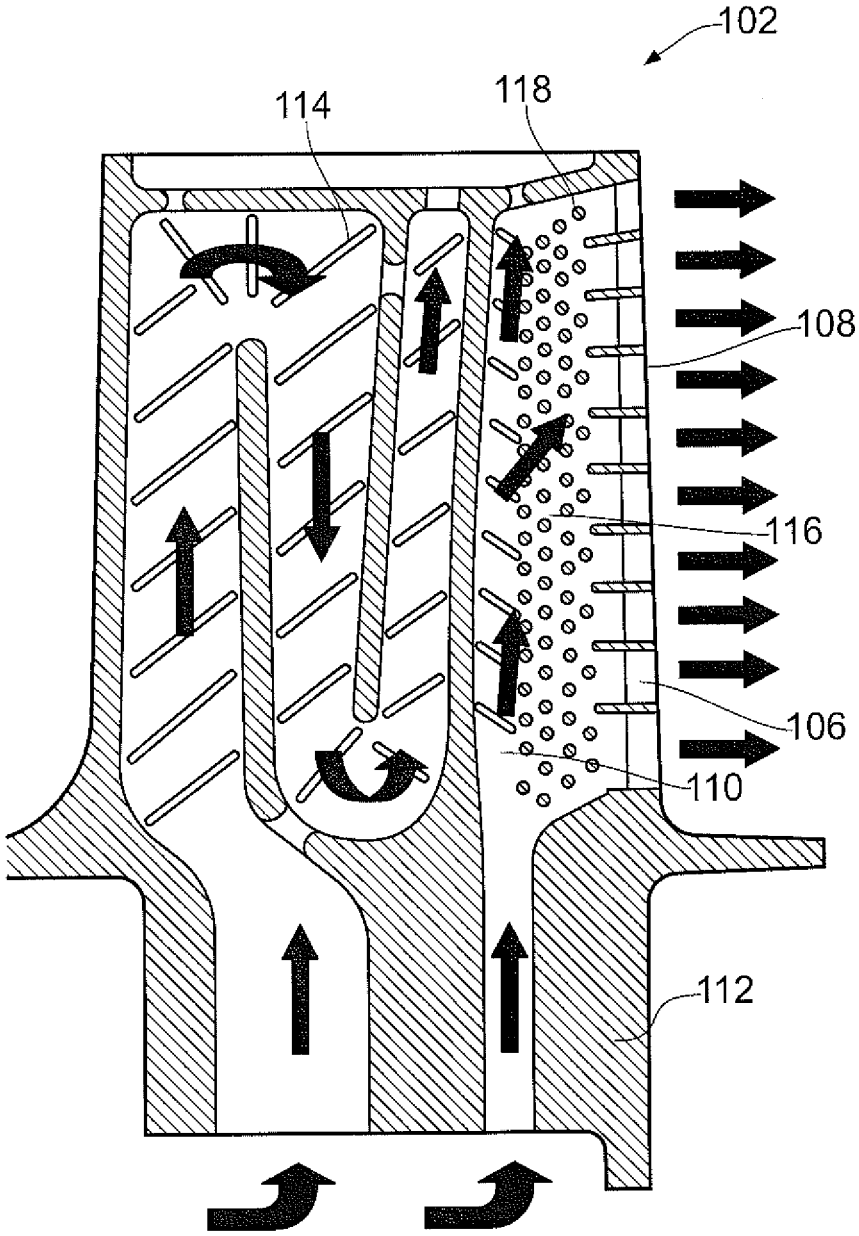
FIG. 3 shows a cross-section though another HP rotor blade.
Figure 4:
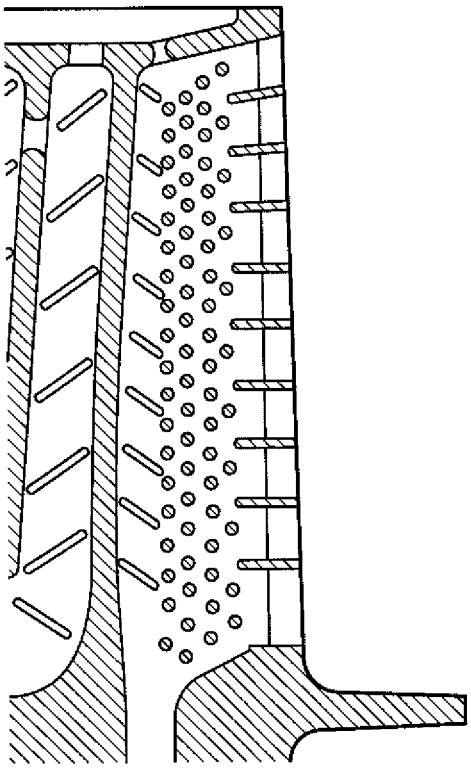
Figure 4:
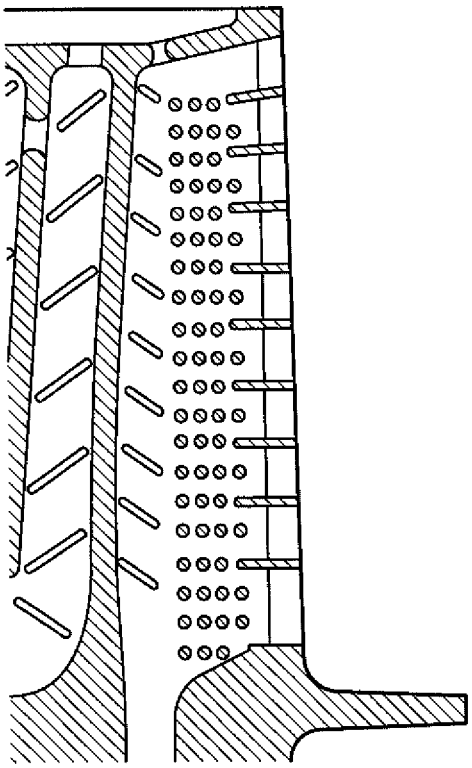
Figure 5:
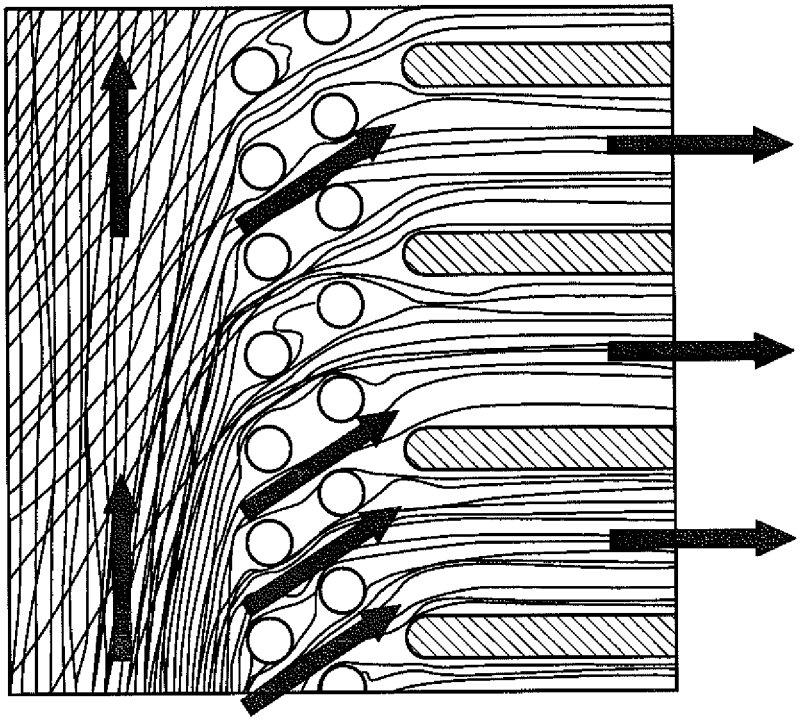
Figure 5:
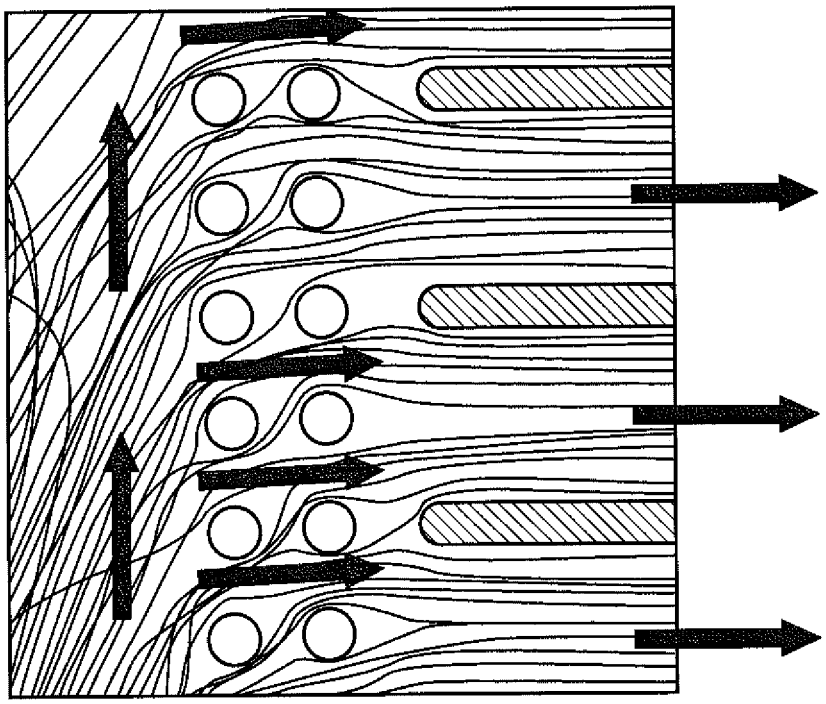
Figure 6:
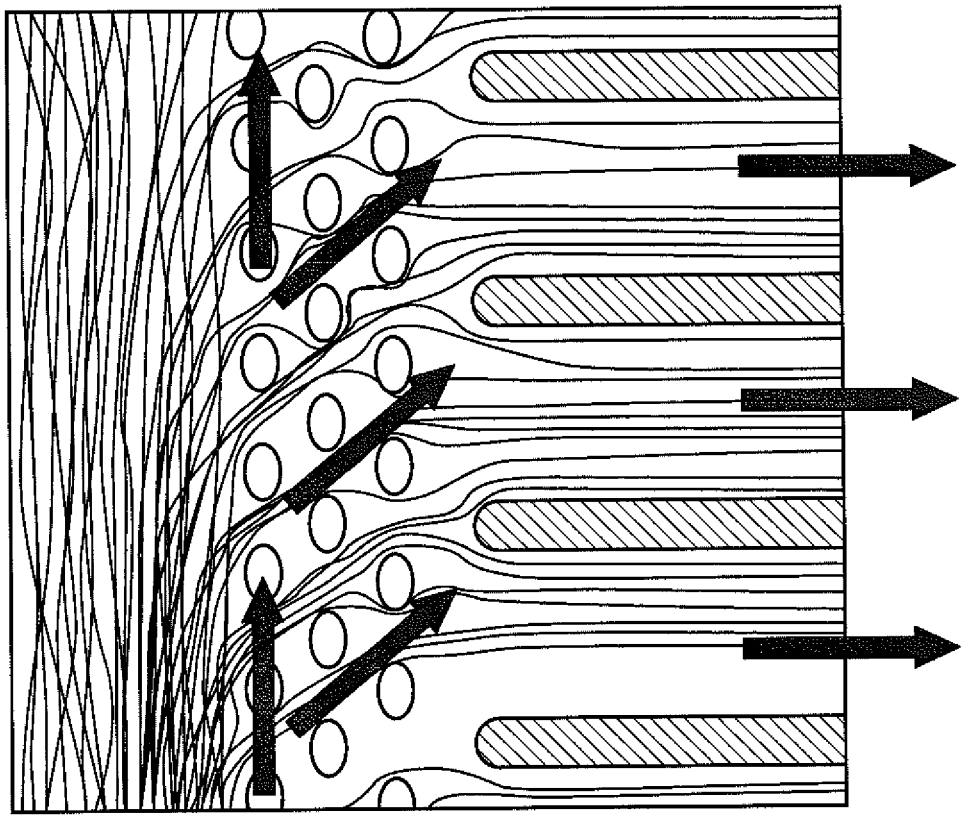
Figure 7:
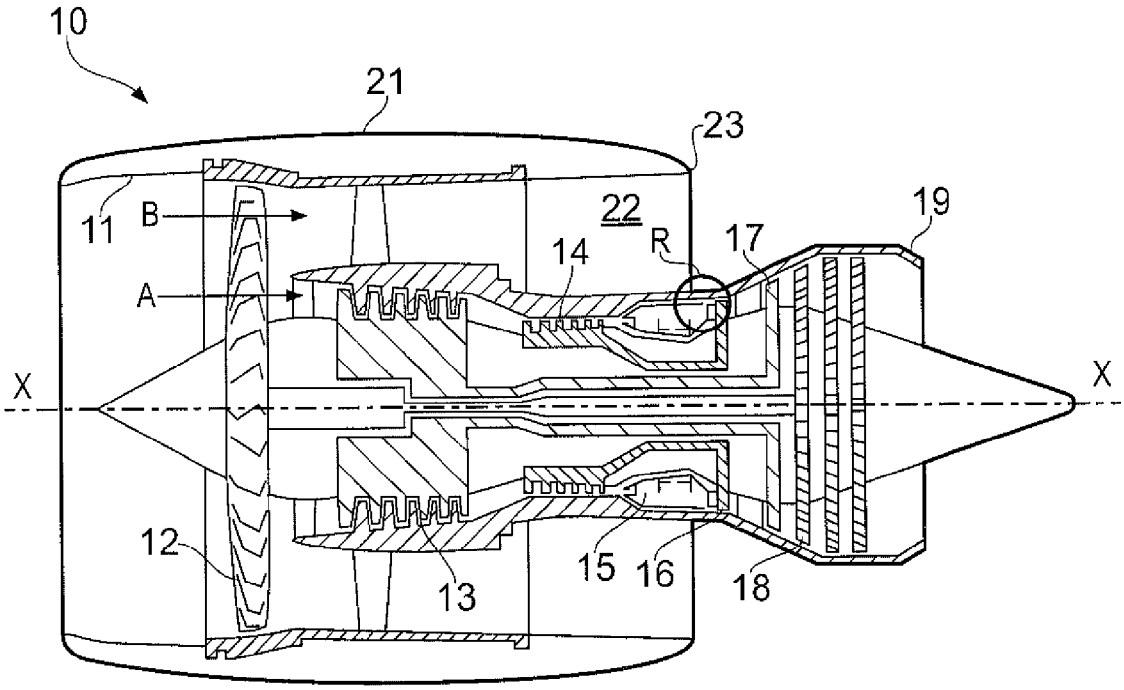
Figure 8:
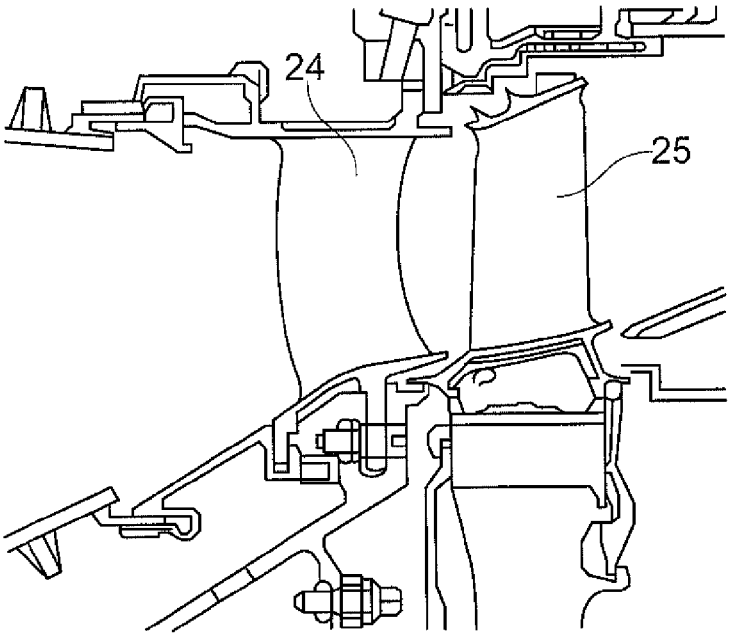
Figure 9:
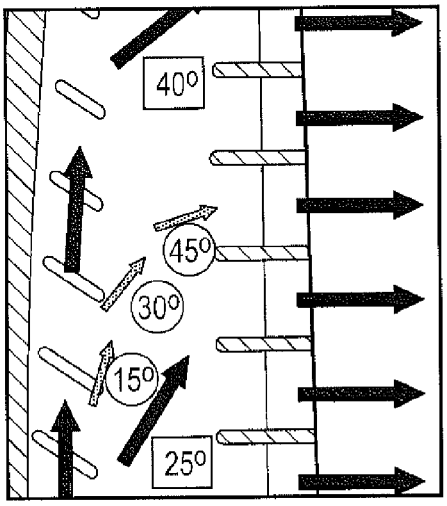
Figure 9:
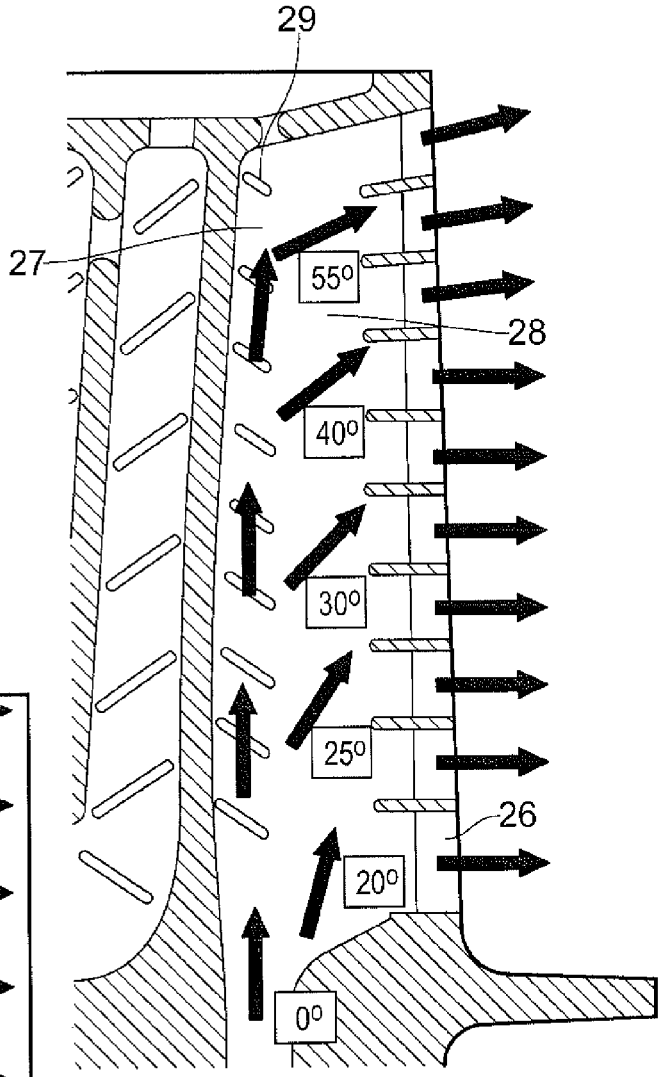
Figure 10:
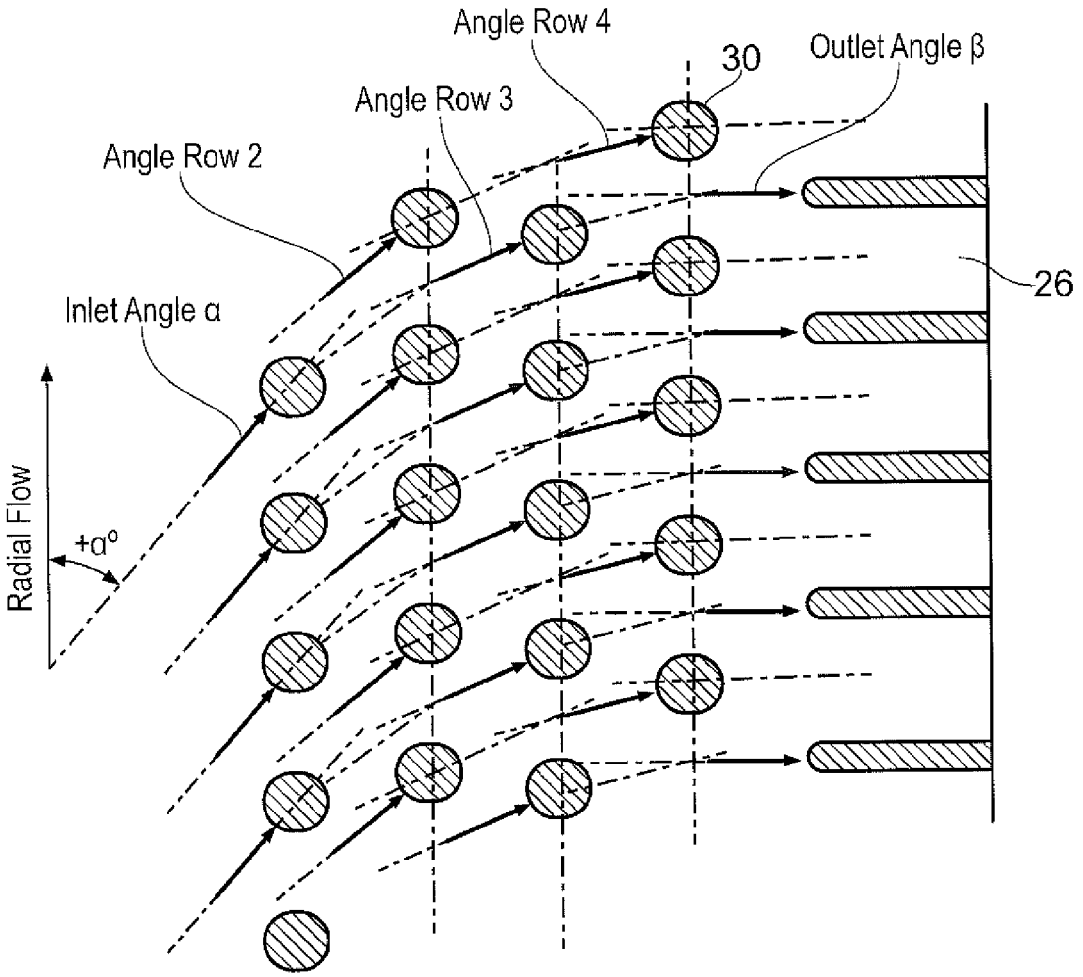
Figure 11:
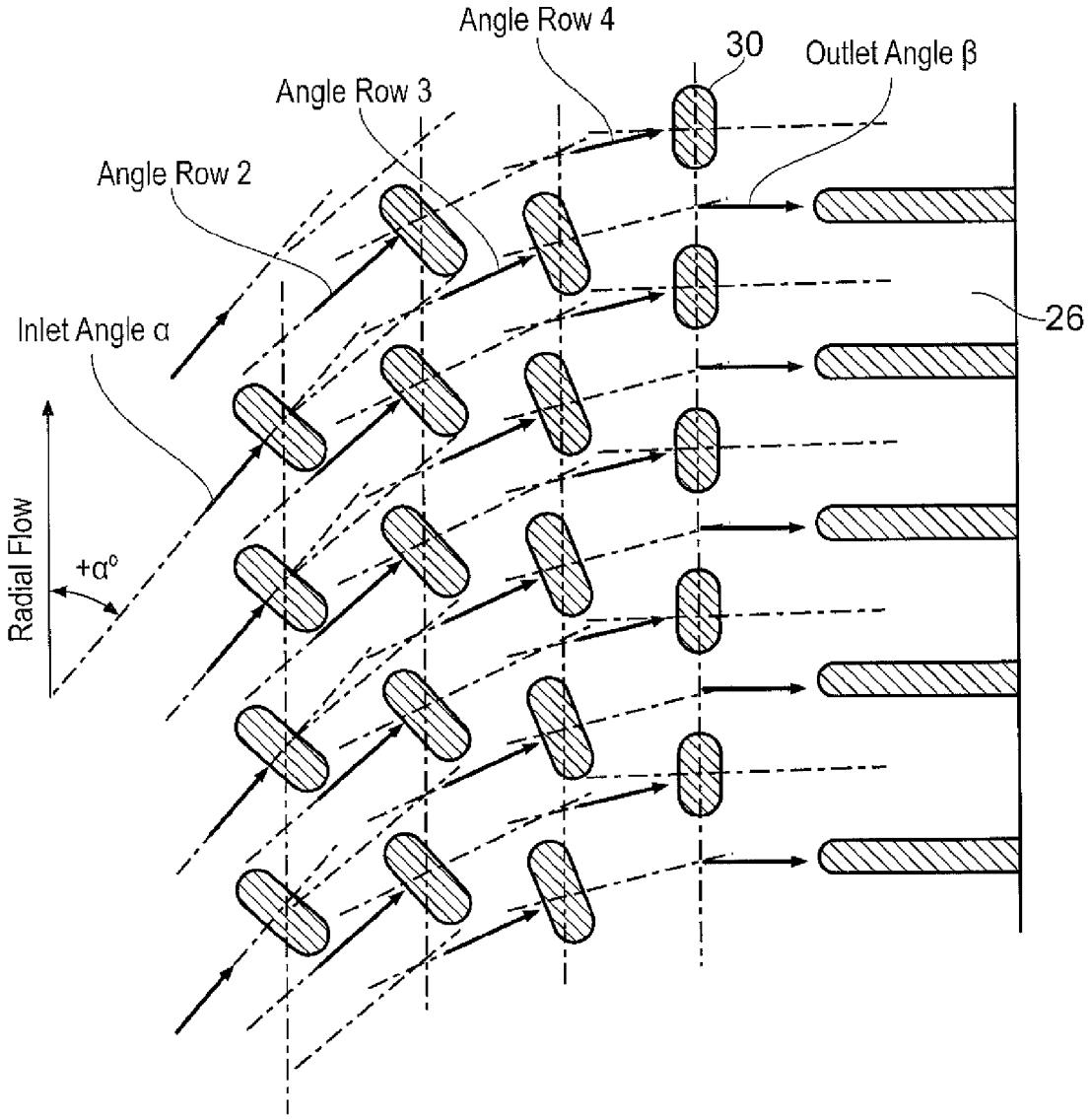
Figure 12:
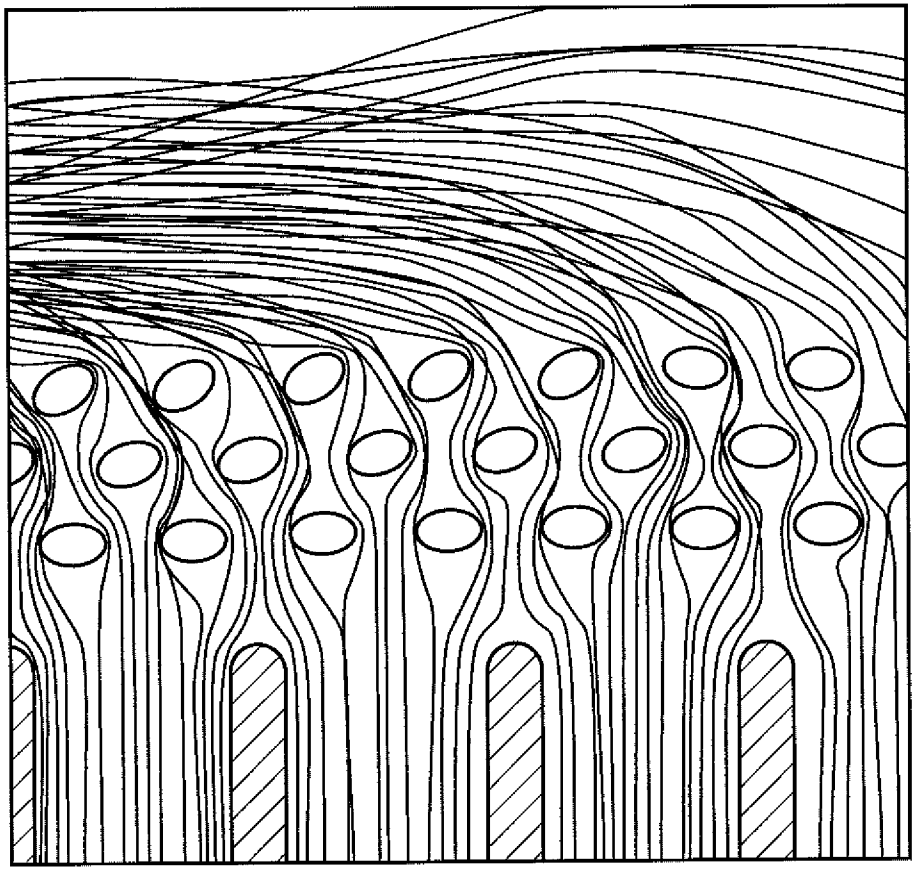

FIGS. 4 (*a*) and 4 (*b*) show close-up cross-sectional views of the trailing edge regions of two blades of the type shown in FIG. 3;

FIGS. 5 (*a*) and 5 (*b*) show 3D computational fluid dynamics streak lines for 5 (*a*) staggered and 5 (*b*) aligned pedestal formations;

FIG. 6 shows 3D computational fluid dynamics streak lines for staggered racetrack-shaped pedestals;

FIG. 7 shows a longitudinal cross-section through a ducted fan gas turbine engine;

FIG. 8 shows in more detail the circled region labelled R in FIG. 7;

FIGS. 9 (*a*) and 9 (*b*) shows 9 (*a*) a cross-section through the trailing edge region of a blade superimposed with average flow angles determined by computational fluid dynamics, and 9 (*b*) more detail of changing flow angles at the mid-span position having an average flow angle of 30°;

FIG. 10 shows schematically four rows of circular cross-section pedestals;

FIG. 11 shows schematically four rows of racetrack shaped cross-section pedestals; and FIG. 12 shows 3D computational fluid dynamics streak lines for racetrack-shaped pedestals;

With reference to FIG. 7, a ducted fan gas turbine engine incorporating the invention is generally indicated at 10 and has a principal and rotational axis X-X. The engine comprises, in axial flow series, an air intake 11, a propulsive fan 12, an intermediate pressure (IP) compressor 13, a high-pressure (HP) compressor 14, a combustor 15, a high-pressure (HP) turbine 16, and intermediate pressure (IP) turbine 17, a low-pressure (LP) turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the IP compressor 13 and a second air flow B which passes through the bypass duct 22 to provide propulsive thrust. The IP compressor 13 compresses the air flow A directed into it before delivering that air to the HP compressor 14 where further compression takes place.

The compressed air exhausted from the HP compressor 14 is directed into the combustor 15 where it is mixed with fuel and the mixture combusted. The resultant hot combustion products then expand through, and thereby drive the HP, IP and LP turbines 16, 17, 18 before being exhausted through the nozzle 19 to provide additional propulsive thrust. The HP, IP and LP turbines respectively drive the HP and IP compressors 14, 13 and the fan 12 by suitable interconnecting shafts.

FIG. 8 shows in more detail the circled region labelled R in FIG. 7, containing the NGVs 24 and turbine blades 25 of the HP turbine 16.

As shown in FIG. 9(*a*), which is a cross-section through the trailing edge region of one of the blades 25, each blade has a line of cooling air discharge slots 26 at it trailing edge, an internal cooling channel 27 forward of and extending substantially parallel to the line of discharge slots, and an internal feed cavity 28 between the channel and the line of discharge slots for feeding cooling air from the channel to the discharge slots. The cooling channel contains trip strips 29, and flow disrupting pedestals (not shown in FIGS. 9 (*a*) and 9 (*b*)) in the form of circular cross-section columns extend between opposing pressure surface and suction surface sides of the feed cavity. The pedestals are arranged in a number N of rows which extend substantially parallel to the line of discharge slots. The first row is at the entrance from the cooling channel to the feed cavity, the $N^{th}$ row is at the exit from the feed cavity to the discharge slots, and the remaining rows are spaced therebetween. The pedestals are spaced apart from each other within each row.

A methodology is used for determining a configuration for the pedestals to improve the cooling air flow structure in the feed cavity 28. The methodology locates the pedestals in such a manner as to encourage the coolant flow to split to either side of each individual pedestal, and in so doing reduces the risk of the flow "jetting" between neighbouring pedestals.

In a first stage, the approximate inlet flow angle distribution to the first row of pedestals is determined. This distribution can be obtained, for example, from a rudimentary CFD analysis in which the pedestals are arranged in a regular staggered configuration (e.g. as shown in FIG. 4(*a*)).

The average flow angle determined from this analysis from the first to the last row of pedestals at different radial positions along the cavity 28 are indicated in rectangular boxes and illustrated with respective block arrows in FIG. 9(*a*). Thus in the radial direction, the average flow angle changes from a wholly radial direction at the root (0°), to a predominantly radial direction at the mid span location (30°), and finally to a less predominantly radial direction (55°) at the tip of the feed passage. The inlet flow angle to the first row of pedestals also changes from 0° at the root to about 15° at mid span and then to about 30° at the tip.

FIG. 9(*b*) shows in more detail the changing flow angles through the pedestal rows at the mid-span position which has an average flow angle of 30° in FIG. 9(*a*). At this mid-span location, the inlet angle to the first row of pedestals is 15° and progressively changes through the rows of pedestals to 45° at the inlet to the final row of pedestals, resulting in an average flow angle of 30° through the pedestal bank.

For the purpose of the pedestal configuration methodology, the outlet angles of the final row of pedestals can be determined to be the same as the inlet angle to the local discharge slot FIG. 10 shows schematically four, approximately equidistantly spaced, rows of circular cross-section pedestals 30. The pedestals are configured to provide a flow distribution between the $1^{st}$ row of pedestals and the trailing edge discharge slots 26 which reduces "jetting" and provides good pressure drop and heat transfer characteristics. The configuration methodology proceeds as follows:

- The inlet angle to the $1^{st}$ row of pedestals (measured e.g. relative to the radial direction) is determined as described above and designated $\alpha$.
- The outlet angle from the last row of pedestals (also measured e.g. relative to the radial direction) is determined as described above and designated $\beta$.
- The change in angle $\phi$ of the direction of cooling air flow between rows is defined as $\phi=(\beta-\alpha)/N$, where N is the number of pedestal rows (four in this case).
- The pedestals of the $N^{th}$ row are positioned. For example, they may be centred relative to the entrances of the discharge slots by being positioned on lines that extend forward from the slot centres at angle $\beta$.

Working row-by-row forward from the $N^{th}$ row, the pedestals of the preceding row are then positioned such that a line extending forward (upstream) from the centre of each pedestal in the $i^{th}$ row at an angle $\{\alpha+\phi(i-1)\}$ intersects the $(i-1)^{th}$ row at a location which is midway between two neighbouring pedestals of the $(i-1)^{th}$ row. Thus, starting at the $N^{th}$ row i=N, and for subsequent rows i reduces by one until, until to position the pedestals of the first row i=2)

The diagram shown in FIG. 10 was constructed based on inlet ($\alpha$) and outlet ($\beta$) angles of 30° and 90° respectively and for four rows of pedestals. Hence the change of angle $\phi$ between rows was 15° and the inlet angles to the rows working in a rearward (downstream) direction were 30°, 45°, 60°, and 75° respectively.

In order that the change in inlet angle to the first row up the span of the blade can be taken into consideration, this type of procedure can be performed at a number of locations (e.g. four, five or six locations) up the blade, and the pedestals between these locations can be located by a process of interpolation.

FIG. 11 shows schematically four, approximately equidistantly spaced, rows of racetrack-shaped cross-section pedestals 30. The pedestals are configured according to the preceding methodology. However, in order that the long axis of the pedestal cross-sections are perpendicular to the direction of flow, and hence that the flat portions of the pedestals are angled against the flow to increase the flow disruption produced by the pedestals, the methodology also includes:

Orientating the pedestals in the $i^{th}$ row (i varying from 1 to N) such that the long axis of the cross-section of each pedestal is perpendicular to a line extending forward from the centre of each pedestal in the $i^{th}$ row at an angle $\{\alpha+\phi(i-1)\}$.

The aspect ratio of the racetrack shaped pedestals can be varied depending on different flow blockage requirements. The circular and non-circular pedestals may also be combined in the same feed cavity 28.

FIG. 12 shows 3D CFD streak lines for the trailing edge region of a blade in which the cooling channel contains trip strips and the feed cavity contains three rows of racetrack-shaped pedestals configured and orientated according to the above methodology. The excellent coolant flow structure exhibits streak lines which are evenly distributed around the pedestals and which substantially completely recombine downstream of the pedestals.

There is also no evidence of "jetting" between the pedestals. By closely adhering to the design process outlined above it is possible to regularly produce flow structures of this calibre irrespective of the design geometry for both circular and elongated pedestal arrangements.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A method of configuring an internally cooled gas turbine engine component, the component including:

a line of cooling air discharge holes, an internal cooling channel disposed forward of and extending substantially parallel to the line of discharge holes, an internal feed cavity disposed between the channel and the line of discharge holes for feeding cooling air from the channel to the discharge holes, and a plurality of flow disrupting pedestals extending between opposing sides of the feed cavity, the pedestals being arranged in a number N of rows, which extend substantially parallel to the line of discharge holes, each row of the number N of rows forming flow inlet angles that vary along the length of the rows, a first row of the number N of rows being located closer to an entrance of the feed cavity than an $N^{th}$ row of the number N of rows, and remaining rows of the number N of rows being spaced between the first row and the $N^{th}$ row, and the pedestals being spaced apart from each other within each row, the method including:

determining the flow inlet angle $\alpha$ of a direction of cooling air flow into the first row at one or more radial positions;

determining a flow outlet angle $\beta$ of the direction of cooling air flow from the $N^{th}$ row;

defining a change in angle $\phi$ of the direction of cooling air flow between the rows as $\phi=(\beta-\alpha)/N$ for the one or more radial positions; and starting from row N, positioning the pedestals such that a line extending forward from the centre of each pedestal in the $i^{th}$ row at an angle $\{\alpha+\phi(i-1)\}$ intersects the $(i-1)^{th}$ row at a location which is midway between two neighbouring pedestals of the $(i-1)^{th}$ row, i being an integer from 2 to N.

2. The method according to claim 1, wherein the rows are spaced substantially equal distances apart.

3. The method according to claim 1, wherein the method further includes:

determining the number of pedestals in the $N^{th}$ row such that each pedestal of the $N^{th}$ row corresponds to a respective one of the discharge holes; and positioning each pedestal of the $N^{th}$ row such that a line extending rearward from the pedestal at the flow outlet angle $\beta$ coincides with the centre of the respective discharge hole.

4. The method according to claim 1, wherein N is four or more.

5. The method according to claim 1, wherein the pedestals are each a column of circular cross-section.

6. The method according to claim 1, wherein the pedestals are each a column of racetrack-shaped or elliptical cross-section.

7. The method according to claim 6, wherein the method further includes:

orientating the pedestals such that a long axis of the racetrack-shaped or elliptical cross-section of each pedestal is perpendicular to a line extending forward from the centre of each pedestal in the $i^{th}$ row at an angle $\{\alpha+\phi(i-1)\}$, i being an integer from 1 to N.

8. The method according to claim 1, wherein the value of the flow inlet angle $\alpha$ varies along the length of the first row.

9. The method according to claim 1, wherein the component is a gas turbine aerofoil, the pedestals extending between pressure surface and suction surface sides of the feed cavity.

10. The method according to claim 9, wherein the line of cooling air discharge holes is a line of slots along a trailing edge of the aerofoil.

11. A process for producing an internally cooled gas turbine engine component, the process including:

configuring the component by performing the method of claim 1; and manufacturing the configured component.

12. An internally cooled gas turbine engine component produced by the process of claim 11.

13. An internally cooled gas turbine engine component, the component comprising:

a line of cooling air discharge holes, an internal cooling channel disposed forward of and extending substantially parallel to the line of discharge holes, an internal feed cavity disposed between the channel and the line of discharge holes for feeding cooling air from the channel to the discharge holes, and a plurality of flow disrupting pedestals extending between opposing sides of the feed cavity, the pedestals being arranged in a number N of rows, which extend substantially parallel to the line of discharge holes, each row of the number N of rows forming flow inlet angles that vary along the length of the rows, a first row of the number N of rows being located closer to an entrance of the feed cavity than an $N^{th}$ row of the number N of rows, remaining rows of the number N of rows being spaced between the first row and the $N^{th}$ row, and the pedestals being spaced apart from each other within each row, the first row defining a flow inlet angle $\alpha$ of a direction of cooling air flow into the first row at one or more radial positions, the $N^{th}$ row defining a flow outlet angle $\beta$ of the direction of cooling air flow from the $N^{th}$ row, a change in angle $\phi$ of the direction of cooling air flow between the rows being defined as $\phi=(\beta-\alpha)/N$ for the one or more radial positions, and the pedestals being positioned such that a line extending forward from the centre of each pedestal in the $i^{th}$ row at an angle $\{\alpha\pm\phi(i-1)\}$ intersects the $(i-1)^{th}$ row at a location which is midway between two neighbouring pedestals of the $(i-1)^{th}$ row, i being an integer from 2 to N, wherein each pedestal is positioned such that a plurality of streak lines of cooling air advancing on the pedestals split substantially equally to both sides of each pedestal and then substantially completely recombine downstream of each pedestal.

14. The component according to claim 13, wherein the component is a gas turbine aerofoil, the pedestals extending between pressure surface and suction surface sides of the feed cavity.

15. The component according to claim 14, wherein the line of cooling air discharge holes is a line of slots along a trailing edge of the aerofoil.

* * * * *